US010800628B2

(12) United States Patent
Haapanen et al.

(10) Patent No.: US 10,800,628 B2
(45) Date of Patent: Oct. 13, 2020

(54) TURN-UP METHOD AND A TURN-UP DEVICE FOR A REEL-UP FOR REELING OF FIBER WEBS

(71) Applicant: Valmet Technologies Oy, Espoo (FI)

(72) Inventors: Jaakko Haapanen, Järvenpää (FI); Kimmo Penttilä, Järvenpää (FI); Vesa Riihelä, Halkia (FI); Kai Forssen, Järvenpää (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/268,004

(22) Filed: Feb. 5, 2019

(65) Prior Publication Data

US 2019/0241389 A1 Aug. 8, 2019

(30) Foreign Application Priority Data

Feb. 6, 2018 (EP) ..... 18155283

(51) Int. Cl.
*B65H 19/26* (2006.01)
*B65H 19/28* (2006.01)
(Continued)

(52) U.S. Cl.
CPC ..... *B65H 19/26* (2013.01); *B65H 18/08* (2013.01); *B65H 19/265* (2013.01);
(Continued)

(58) Field of Classification Search
CPC .... B65H 19/26; B65H 19/265; B65H 19/286; B65H 19/28; B65H 19/29;
(Continued)

(56) References Cited

U.S. PATENT DOCUMENTS 4,182,170 A * 1/1980 Grupp ..... B26F 3/004 162/286
5,360,179 A 11/1994 Vesterinen et al.
(Continued)

FOREIGN PATENT DOCUMENTS

CA 2265087 A1 9/2000
DE 10306908 A1 9/2004
(Continued)

OTHER PUBLICATIONS

European Search Report for EP18155283 dated Jul. 30, 2018.

*Primary Examiner* — Mark A Osele
*Assistant Examiner* — Christopher C Caillouet
(74) *Attorney, Agent, or Firm* — Stiennon & Stiennon

(57) ABSTRACT

In a turn-up method for a reel-up for reeling of fiber webs, a web travelling in direction (S) is cut by two water jet nozzles moving in a transverse direction in relation to the web travelling direction (S). Two cuts (C1, C2) are formed by two water jet nozzles starting from the edges of the web (W) and moving to the web center where the cuts (C1, C2) cross or meet forming a V-shaped tail end (V1). After the cuts the movement of the water jet nozzles is stopped and after the return movement of the water jet nozzles, cutting is started again from the center toward the edges so that the web W is cut by two cuts (C3, C4) and a substantially V-shaped beginning end (V2) to the web W is formed and between the cuts (C1, C2) for the tail end (V1) and the cuts (C3, C4) for the beginning end (V2) there is formed one web reject part (R) with two substantially V-shaped cuts. A turn-up device for a reel-up for reeling of fiber webs has two water jet nozzles, in which the cutting by the water jet nozzles (10,12) may be stopped between cutting of a tail end (V1) and cutting of a beginning end (V2) for a selected time for forming only, wherein there is one reject part (R) in the
(Continued)

turn-up and the cross-direction travel distance (L1, L2) of each nozzle is substantially shorter than the width (L) of the web (W).

16 Claims, 3 Drawing Sheets

(51) Int. Cl.
*B65H 18/08* (2006.01)
*B65H 19/29* (2006.01)

(52) U.S. Cl.
CPC ..... *B65H 19/286* (2013.01); *B65H 19/29* (2013.01); *B65H 2301/41898* (2013.01); *B65H 2301/5151* (2013.01); *B65H 2301/51534* (2013.01); *B65H 2406/211* (2013.01); *B65H 2511/25* (2013.01); *B65H 2513/51* (2013.01); *B65H 2601/511* (2013.01); *B65H 2801/84* (2013.01)

(58) Field of Classification Search
CPC ..... B65H 2301/51534; B65H 2301/41898; B65H 2601/511
See application file for complete search history.

(56) References Cited

U.S. PATENT DOCUMENTS

| | | | | |
|---|---|---|---|---|
| 8,628,641 | B2 * | 1/2014 | Hilker | B65H 19/265 162/193 |
| 2020/0039777 | A1 * | 2/2020 | Hilker | B65H 19/286 |

FOREIGN PATENT DOCUMENTS

| | | | |
|---|---|---|---|
| EP | 0765832 | A2 | 4/1997 |
| EP | 1026110 | A2 | 8/2000 |
| EP | 2812268 | B1 | 10/2017 |

* cited by examiner

TURN-UP METHOD AND A TURN-UP DEVICE FOR A REEL-UP FOR REELING OF FIBER WEBS

CROSS REFERENCES TO RELATED APPLICATIONS

This application claims priority on application EP 18155283, filed Feb. 6, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to reel-ups for reeling of fiber webs. In particular, the present invention relates to a turn-up method for a reel-up for reeling of fiber webs which utilizes two water jets cutting inwardly from the web edges.

As known, fiber webs, such as paper or board webs, are manufactured in machines together forming a fiber web manufacturing line, which may be hundreds of meters long. Modern paper machines may produce more than 450,000 tons of paper per year. The speed of a paper machine may exceed 2,000 m/min and the width of a paper web may be more than 11 meters.

As known from the prior art, fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise finishing devices, for example a calender and/or a coater. The production and treatment line also comprises typically at least one slitter-winder for forming customer rolls as well as a roll packaging apparatus.

In fiber web production lines, manufacturing operates as a continuous process. The finished fiber web being output from the machine is wound with a reel-up around a reeling shaft, i.e. a reel spool, into a parent roll (a machine roll), the diameter of which may be more than 5 meters and which may weigh more than 160 tons. The purpose of the reeling is to transfer the fiber web from its planar manufacturing form into a form in which it can be handled more easily. At the reel-up, which is located in the main production line, the continuous process of the production line is interrupted for the first time, after which the process continues in stages. Every attempt is made to interlink these stages as smoothly as possible so that the work already performed would not be wasted.

Reel-ups are used in fiber web production for reeling the fiber web coming from the fiber web production line, a coating machine, a calender or corresponding finishing device.

In the reel-up the parent roll is formed around the reeling shaft operating as the reeling core, i.e. the fiber web being on one parent roll has a start and an end.

When a parent roll has been reeled to its full diameter and it is completed, a turn-up is performed for finishing the reeling of the completed parent roll and for beginning the reeling of a new parent roll around a new reeling shaft or like reeling core. In the turn-up the fiber web is cut typically such that a wedge like tip is formed to the web by one or two cutting devices and the final end, i.e. tail, of the fiber web is attached on the surface of the completed parent roll and the beginning end, i.e. tip, of the fiber web is attached on the new reeling shaft. For attaching the tail of the fiber web onto the surface of the completed parent roll it is known from prior art to add adhesive, such as glue, on the surface of the parent roll or on the surface of the fiber web near the edges of the fiber web just before the turn-up. For this purpose, an attaching device has been arranged in connection with the reel up.

In U.S. Pat. No. 5,360,179 is disclosed a method for reeling a web, comprising the steps of: reeling a web from a first roll onto a second roll, initiating the cutting and forming of a tip part from the web by directing one water jet against the web at a first edge thereof, blowing the tip part into contact with a third roll, such that the tip part of the web begins to reel onto the third roll, and directing said water jet to a second edge of the web opposite from said first edge to sever the web across its entire width so that the web stops reeling onto the second roll and begins to reel onto the third roll. In this US patent there is also disclosed a device for changing the reeling a web from successive rolls, comprising a frame, a first roll arranged to reel a web onto a second roll, water nozzle means arranged on said frame for directing a water jet onto the web in proximity to the first roll to initiate the cutting and forming of a tip part into the web, said water nozzle means consisting of one water jet positioned to start cutting the web at one edge thereof and ending at an opposite edge of the web, and air nozzle means arranged on said frame for directing an air jet onto the tip part of the web to direct the tip part onto a third roll when a desired diameter size of the second roll is reached, said water nozzle means further constituting means to direct said water jet across the entire width of the web after the tip part has been reeled around the third roll to sever the web and stop the web from reeling onto the second roll, the web then being reeled onto the third roll.

In EP patent publication 2812268 is disclosed a web turn-up cutting apparatus for severing a continuous web that is traveling in a travel direction, the apparatus comprising: a first nozzle connectable to a first water supply hose and adapted to produce a first water cutting jet and a second nozzle connectable to a second water supply hose and adapted to produce a second water cutting jet, the first nozzle and the second nozzle each being mountable on respective nozzle carriages and being transversely movable with respect to the travel direction of the continuous web; a jet controller adapted to activate a water supply of the first water supply hose for the first nozzle to produce the first water cutting jet and to activate a water supply of the second water supply hose for the second nozzle to produce the second water cutting jet; and a carriage controller adapted to actuate the nozzle carriages to provide a transversal movement of the first nozzle and of the second nozzle; wherein the first nozzle and the second nozzle define together a substantially X-shaped cut on the traveling continuous web, the substantially X-shaped cut defining at least a substantially V-shaped tail for ending a forming roll, an opposite substantially V-shaped start for starting a new spool, a detachable first wing and a detachable second wing. In this EP patent is also disclosed a method of manufacturing paper in a papermaking machine, the method comprising steps: defining a substantially X-shaped cut in a traveling continuous paper web of the papermaking machine, the substantially X-shaped cut forming at least a substantially V-shaped tail for ending a forming roll, an opposite substantially V-shaped start for starting a new spool, a detachable first wing and a detachable second wing; detaching the detachable first wing and the detachable second wing from the traveling continuous paper web; and distancing the substantially V-shaped tail from the substantially V-shaped start by allowing the substantially V-shaped start to engage a new spool. In this arrangement control of two detachable wings sets high demands for the control of the reject wings in order to guide them both securely to a pulper. Also in this arrangement long travel distance for the nozzles are needed as both travel from one edge of the fiber web to the other edge and thus problems relating to control of the long movement of the nozzles may occur.

In EP patent publication 0765832 is disclosed a device in reeling of a fiber web, paper or board web, a belt reel in which the fiber web is supported by a belt when guided in the reel-up on to the reeling shaft, which device further comprises a reeling cylinder and a reeling shaft (a reeling spool), the web being fitted to run through the nip between said cylinder and reeling shaft onto the reeling shaft. This device further comprises members for guiding the web tip (beginning end of the web) that was cut at the turn-up (the reel change) onto the new reeling shaft and a change device (a turn-up device), which includes displaceable water cut nozzles and displaceable adhesive nozzles. The change device includes sledges and to same sledge have been attached one water jet nozzle and one adhesive nozzle. The sledges are movable along guides so that the water cut nozzles and the adhesive nozzles operate substantially at the same time and are placed in a relative position so that parallel to each water cut substantially at uniform distance of the water cut and adhesive strip is formed at the side of the web that passes onto the complete parent roll (the reel).

In the known methods and devices for turn-up several disadvantages and problems may occur: Often in connection with the methods and devices known from prior art a lot of space is needed for the equipment and thus it might be difficult to find a cost-effective solution for the turn-up device.

SUMMARY OF THE INVENTION

An object of the invention is to create a turn-up method and a turn-up device for a reel-up for reeling of fiber webs, in which disadvantages and problems of known methods and devices are eliminated or at least minimized.

In particular, a further object of the invention is to create a turn-up method and a turn-up device for a reel-up for reeling of fiber webs, in which disadvantages and problems relating to control of a reject fiber web detached during the turn-up are eliminated or at least minimized.

In particular, a further object of the invention is to create a turn-up method and a turn-up device for a reel-up for reeling of fiber webs, in which disadvantages and problems relating to control of nozzle movements during the turn-up are eliminated or at least minimized.

In accordance with the invention in a turn-up method for a reel-up for reeling of fiber webs, a fiber web travelling in a travelling direction is cut by means of two water jet nozzles moving substantially in a transverse direction in relation to the travelling direction of the fiber web, in the method two cuts are formed by two water jet nozzles starting their movement at latest from edges of the fiber web and moving with the cutting pressure of the water jet nozzles toward the center area of the fiber web and at the center area of the fiber web the cuts cross or meet and a substantially V-shaped tail end to the fiber web is formed, after the cuts of the tail end of the fiber web are finished and the movement of the water jet nozzles and the cutting by the water jet nozzles is stopped and after the stop the return movement of the water jet nozzles and the cutting by the water jet nozzles is started again from the center area of the fiber web and the water jet nozzles are moved toward the edges of the fiber web so that the fiber web W is cut by two cuts and a substantially V-shaped beginning end to the fiber web W is formed and between the cuts for the tail end and the cuts for the beginning end one reject part of the fiber web with two substantially V-shaped cuts is formed.

According to a further advantageous feature of the invention the water jet nozzles are stopped for 0.05-3 seconds, advantageously for 0.1-0.5 seconds.

According to a further advantageous feature of the invention the reject part detaches or is detached from the fiber web and is drawn into a pulper of the reel-up.

According to a further advantageous feature of the invention the tail end is attached to a complete parent roll reeled by the reel-up by adhesive applied on the tail end.

According to a further advantageous feature of the invention the beginning end of the fiber web is picked-up and attached by adhesive applied on the beginning end onto a new reeling shaft, around which reeling of a next parent roll by the reel-up is begun.

In accordance with the invention the turn-up device for a reel-up for reeling of fiber webs comprises two water jet nozzles and means to stop the cutting by the water jet nozzles and the movement of the water jet nozzles between cutting of a tail end and cutting of a beginning end for a selected time for forming only one reject part in the turn-up and that travel distance of each nozzle in the cross-direction of the fiber web is substantially shorter than the width of the fiber web.

According to a further advantageous feature of the invention the travel distance of each nozzle is (0.5-0.75)×the width of the fiber web, advantageously 0.5×the width of the fiber web+0.3 to 1.5 m.

According to a further advantageous feature of the invention the turn-up device comprises means to guide the reject part detached from the fiber web away from the reel-up, advantageously into a pulper of the reel-up, advantageously by creating guiding air flows.

According to a further advantageous feature of the invention the turn-up device comprises adhesive application means for applying adhesive on the tail end and on the beginning end.

According to a further advantageous feature of the invention the means to stop the cutting by the water jet nozzles between cutting of a tail end and cutting of a beginning end, stopping the cutting effect of the water jet nozzles for a selected time.

According to a further advantageous feature of the invention the means to stop the cutting effect of the water jet nozzles comprises means to stop water inlet of the nozzles comprising at least one pressure break valve or at least one mechanical means, or at least one means to change the direction of the cutting jet of the nozzle, advantageously a guide plate, or means to guide the water inlet to another water line.

In this description and the following claims as cutting medium for the nozzles water is mentioned but it is clear to one skilled in the art that as the cutting medium for the nozzles any suitable liquid for cutting can be used.

By the turn-up method and the turn-up device for a reel-up for reeling of fiber webs according to the invention many advantages are achieved: in the turn-up method only one reject part is formed and thus the control of the reject is easy and effective. Furthermore, the travel distance of each nozzle is shorter and thus the movements of the nozzles are easily and securely controllable.

BRIEF DESCRIPTION OF THE DRAWINGS

In the following the invention is described in more detail referring to the accompanying drawings.

DESCRIPTION OF THE PREFERRED EMBODIMENTS

During the course of the following description like numbers and signs will be used to identify like elements according to the different views which illustrate the invention and its advantageous examples. In the figures some repetitive reference signs have been omitted for clarity reasons.

Figure 1:
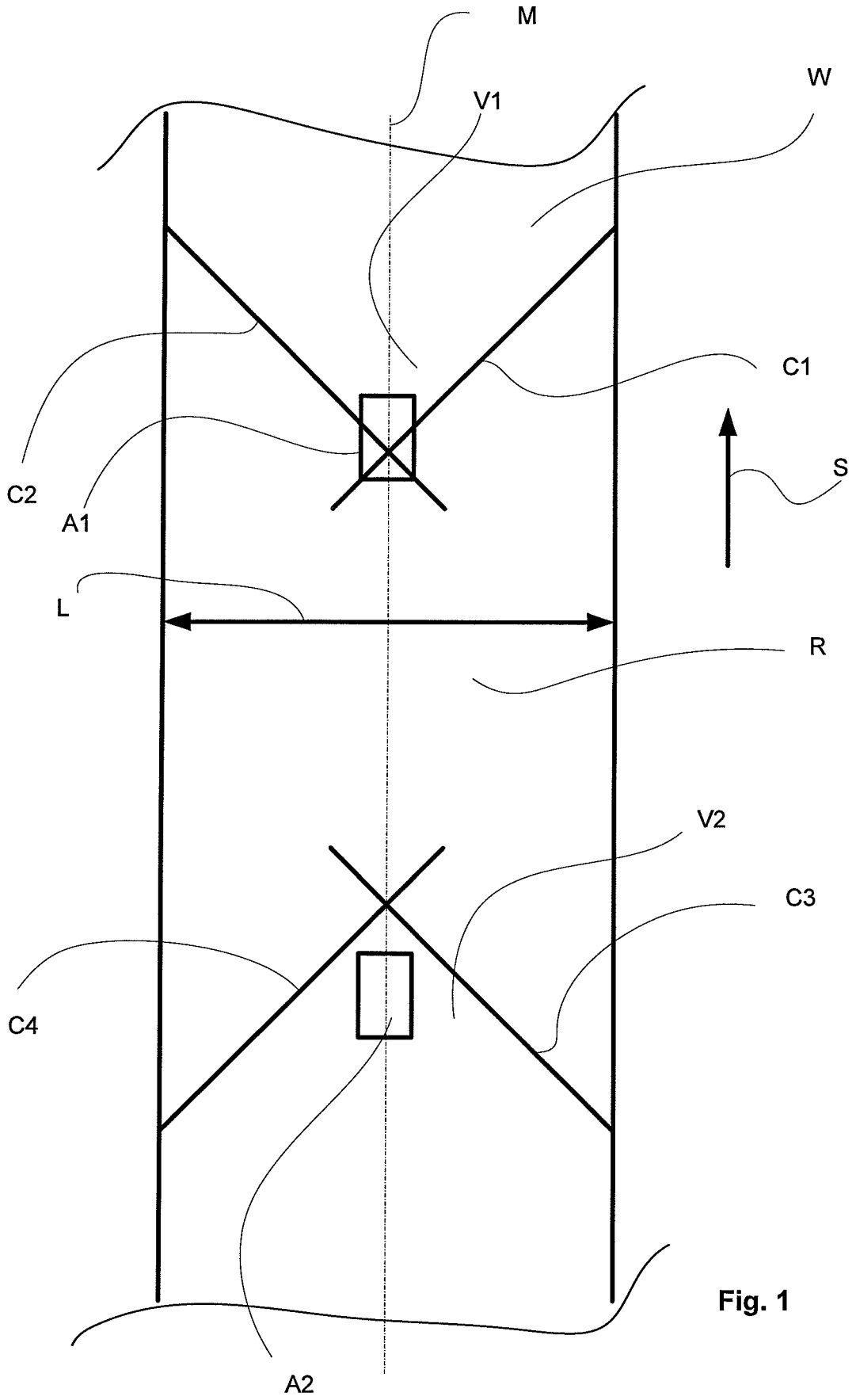
FIG. 1 is a schematic view of cut lines of the fiber web in cutting of the turn-up.
Figure 2A:
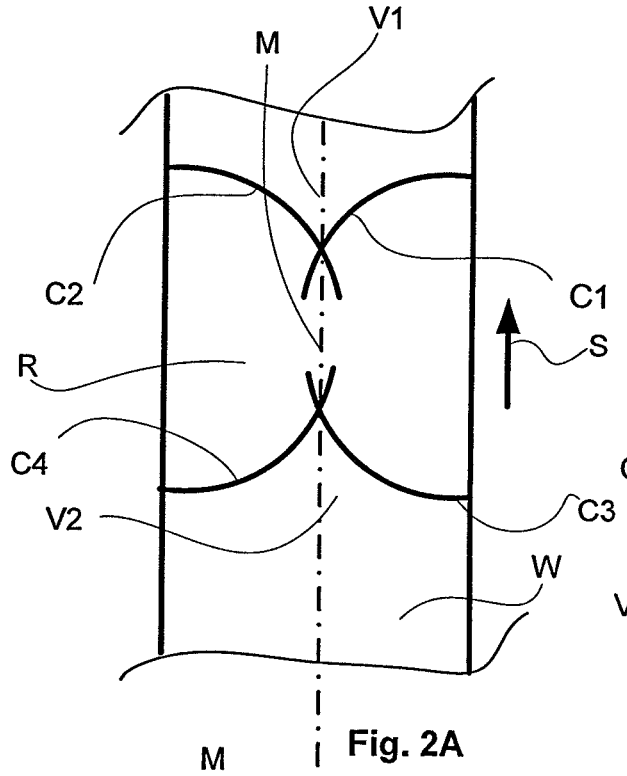
FIGS. 2A-2D schematically show some examples of cutline patterns of the fiber web.
Figure 2B:
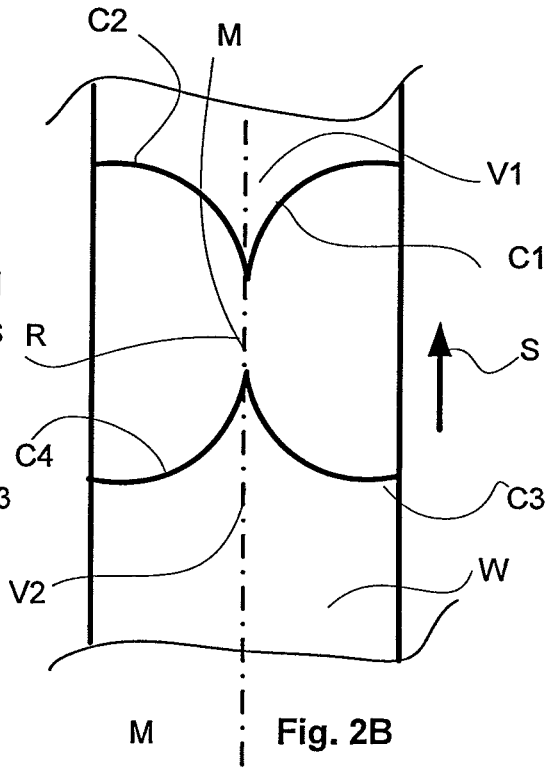
Figure 2C:
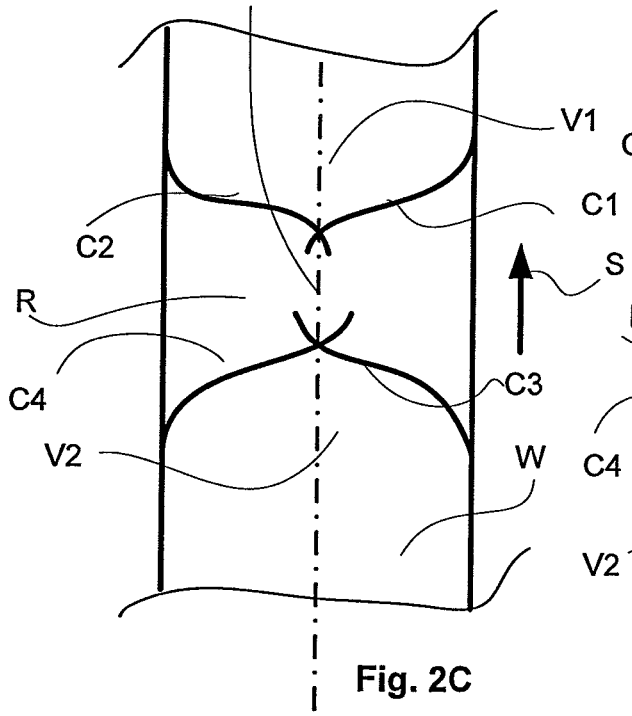
Figure 2D:
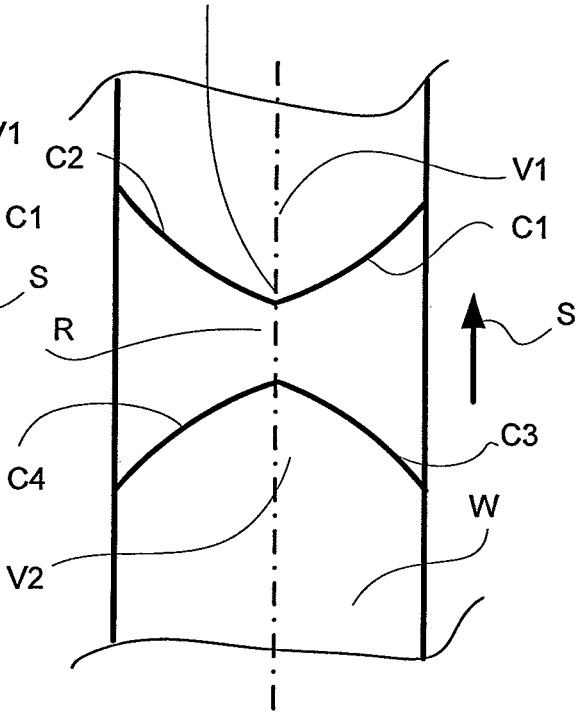

In FIG. 1 schematically shows a fiber web travelling in direction S, i.e., the machine direction. Cutting of the web is carried out by means of two water jet nozzles moving in a transverse or a cross-machine direction in relation to the travelling i.e., machine direction S, of the fiber web W. The water jet nozzles start their movement from the edges of the fiber web W and move toward the imaginary center line M of the fiber web W and cutting pressure from a source of cutting pressure is provided to the water jet nozzles i.e., to form a water jet, and two cuts C1, C2 to the fiber web are formed, which cuts C1, C2 sever the fiber web W in the cross-direction of the fiber web. i.e. in a transverse direction in relation to the travelling direction S of the fiber web W. At the area of the imaginary center line of the fiber web W the cuts C1, C2 cross or reach or meet each other and a V-shaped tail end V1 to the fiber web W is formed as the fiber web W is severed in the cross-direction. Advantageously adhesive A1 is applied onto the fiber web W at least partially covering the tip area of the tail end V1 and the tail end V1 will be attached onto a complete parent roll by the fiber-web-applied adhesive A1. After the cuts C1, C2 of the tail end V1 of the fiber web W are finished, the cutting by the water jet nozzles is stopped and the movement of the water jet nozzles is stopped and the cutting is stopped for a determined time, for example 0.05-3 seconds, advantageously for 0.1-0.5 seconds, during which time water inlet into the water jet nozzles is stopped, i.e. no cutting pressure is applied to the water jet nozzles, so that no cut to the fiber web is formed. The selected time depends for example on the speed of the fiber web W and on the width of the fiber web W and on the cutting speed of the water jet nozzles. After the stopping, the cutting by the water jet nozzles is started again from the area of the imaginary center line M of the fiber web W and the water jet nozzles are moved by return movement toward the edges of the fiber web W and cutting pressure is applied so that the fiber web W is severed in the cross direction by two cuts C3, C4 and a V-shaped beginning end V2 to the fiber web W is formed and adhesive A2 is applied onto the fiber web W at least partially covering the tip area of the beginning end V2. The beginning end V2 of the fiber web W is picked-up and attached by the adhesive A2 onto a new reeling shaft, around which reeling of a next parent roll is begun. Between the cuts C1, C2 for the tail end V1 and the cuts C3, C4 for the beginning end V2 a part of the fiber web W, called the reject part R of the fiber web W, is formed. This reject part R detaches or is detached from the fiber web W and is drawn into a pulper of the reel-up for example by suction or by guiding air flows. The adhesives A1, A2 for attaching the tail end and the beginning end can be glue, tape or a corresponding adhesive.

The adhesive A1, A2 can be applied as an adhesive area or adhesive stripe and it covers at least partially the tip area of the tail end V1 and the tip area of the beginning end V2. The adhesive A1, A2 can also be applied as an adhesive stripe following the corresponding cut line C1, C2 at a desired distance from the cut C1, C2, as known as such to one skilled in the art. The travel distance of each water jet nozzle in the cross-direction is substantially shorter than the width L of the fiber web W. The center area of the fiber web W is the area substantially in the vicinity of the imaginary center line M extending longitudinally in the travelling direction S of the fiber web W. The fiber web travelling in the direction S is cut by two water jet nozzles moving substantially in a transverse direction in relation to the travelling direction S of the fiber web W. Two cuts C1, C2 are formed by two water jet nozzles starting their movement from the edges of the fiber web W and moving toward the center of the fiber web W and at the center area of the fiber web W the cuts C1, C2 cross or meet each other and a substantially V-shaped tail end V1 to the fiber web W is formed, after the cuts C1, C2 of the tail end V1 of the fiber web W are finished the cutting by the water jet nozzles is stopped and after the stop the cutting by the water jet nozzles is started again from the center area of the fiber web W and the water jet nozzles are moved by return movement toward the edges of the fiber web so that the fiber web W is cut by two cuts C3, C4 and a substantially V-shaped beginning end V2 to the fiber web W is formed and between the cuts C1, C2 for the tail end V1 and the cuts C3, C4 for the beginning end V2 one reject part R of the fiber web W with two substantially V-shaped cuts is formed as the fiber web is severed at two locations by tail-end cuts C1, C2 and by beginning end cuts C3, C4.

In FIGS. 2A-2D are shown examples of some cut line patterns, in which the fiber web travelling in direction S is cut by means of two water jet nozzles moving substantially in a transverse direction i.e., a cross-machine direction, in relation to the travelling direction S, i.e., the machine direction of the fiber web W. Two cuts C1, C2 are formed by two water jet nozzles starting their movement from edges of the fiber web W and moving toward the center of the fiber web W and at the center area of the fiber web W the cuts C1, C2 cross or meet each other and a substantially V-shaped tail end V1 to the fiber web W is formed, after the cuts C1, C2 of the tail end V1 of the fiber web W are finished, the cutting by the water jet nozzles is stopped and after the stop the cutting by the water jet nozzles is started again from the center area of the fiber web W and the water jet nozzles are moved toward the edges of the fiber web so that the fiber web W is cut by two cuts C3, C4 and a substantially V-shaped beginning end V2 to the fiber web W is formed and between the cuts C1, C2 for the tail end V1 and the cuts C3, C4 for the beginning end V2 one reject part R of the fiber web W with two substantially V-shaped cuts is formed as the fiber web is severed at two locations by tail-end cuts C1, C2 and by beginning end cuts C3, C4. As can be seen from FIG. 1 the cuts C1, C2, C3, C4 can extend as straight lines but other line patterns are also possible to create the substantially V-shaped cuts as shown in the examples of FIGS. 2A-2D. The cuts C1, C2, C3, C4 can extend as different curved lines that cross or meet each other in the center area of the fiber web. The center area of the fiber web W is the area which is substantially in the vicinity of the imaginary center line M extending longitudinally in the travelling direction S of the fiber web W. Other cut patterns are also possible, for example cuts formed of straight lines forming a broken line pattern. Also, it should be noted that the cut line pattern for one cut line need not to be similar to other cut lines i.e. one or more of the cuts C1, C2, C3, C4 can form a different line pattern from the other cut lines C1, C2, C3, C4.

Figure 3:
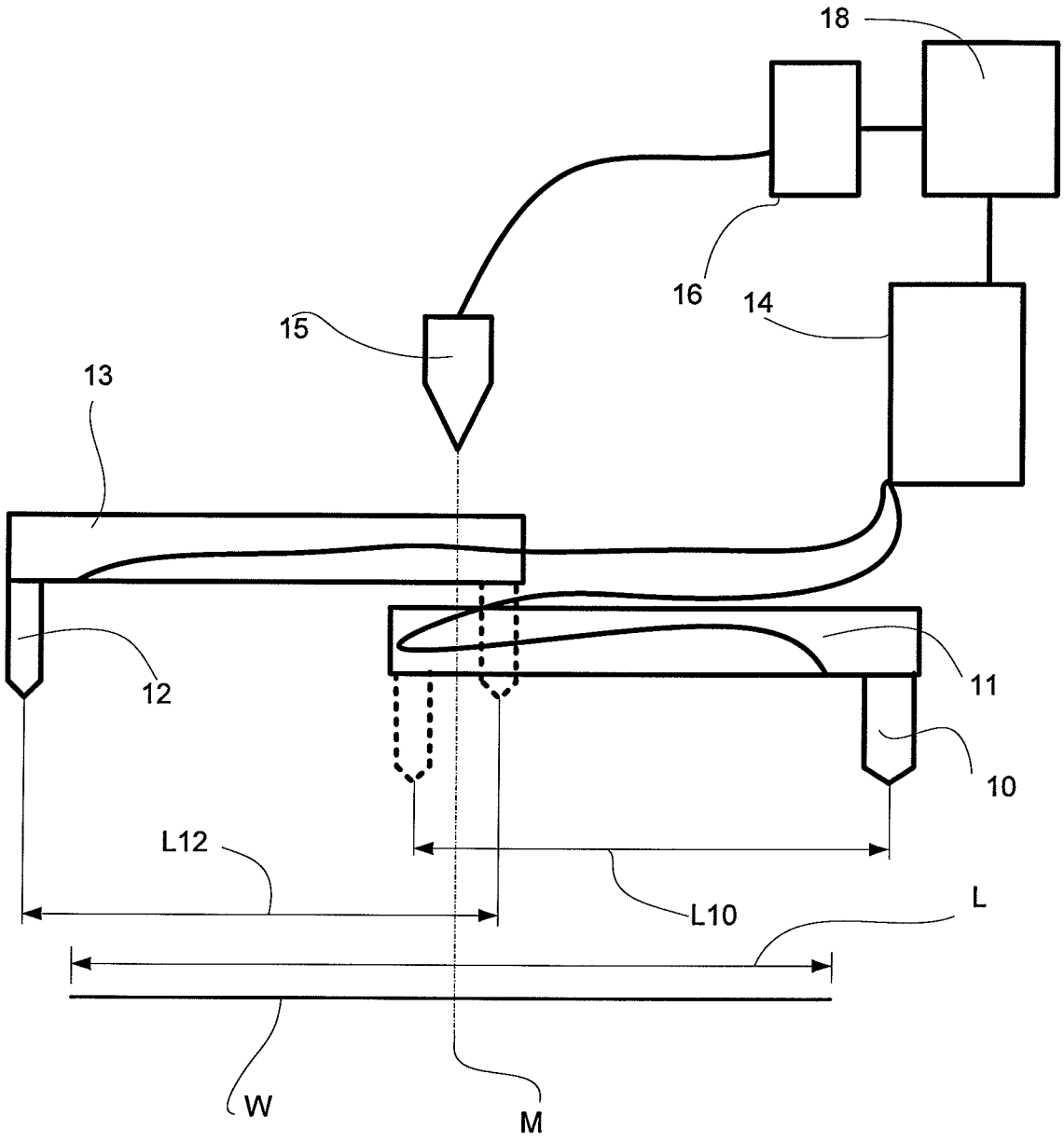
FIG. 3 schematically shows an advantageous example of a turn-up device for a reel-up for reeling of fiber webs according to the invention.

In FIG. 3 is schematically shown an advantageous example of a turn-up device for a reel-up for reeling of fiber webs W. The turn-up device for a reel-up for reeling of fiber webs comprises two water jet nozzles 10, 12 movably attached in guides 11, 13 in the cross-direction of the fiber web, which first cut the tail-end V1 by cutting movement from the edge toward the imaginary center line of the fiber web M and then the cutting and the movement of the water jet nozzles 10, 12 is stopped and after the stop the beginning end V2 of the fiber web W is cut by the return movement of the corresponding water jet nozzle 10, 12 from the center line area toward the two edges of the fiber web W. The turn-up device also comprises means 14 such as valves to stop the cutting by stopping the flow of water to the water jet nozzles between cutting of a tail end V1 and cutting of a beginning end V2 for a selected time so forming only one reject part R in the turn-up and such that the travel distance L10, L12 of each nozzle in the cross-direction of the fiber web W is substantially shorter than the width L of the fiber web. The means 14 to stop the cutting by the water jet nozzles 10, 12 thus comprises control and actuating means 14, such as valves, for the water jet nozzles 10, 12.

The turn-up device also comprises an adhesive applicator 15 for applying adhesive on the tail end V1 to attach the tail end V1 onto the finished parent roll and on the beginning end V2 to attach the beginning end onto the reeling shaft. The adhesive applicator 15 is functionally connected to the control and actuating means 16 such as valves or tape cutters for the adhesive applicator 15. The control and actuating means 14 or valves of the water jet nozzles 10, 12 and the control and actuating means 16 such as valves or adhesive tape cutters for the adhesive applicator 15 can be functionally connected to a turn-up control means 18 such as an electrical, pneumatic, hydraulic, or mechanical devices controlling the turn-up and reeling of the reel up. The travel distance L10, L12 of each nozzle 10, 12, correspondingly, is 0.5×the width L of the fiber web+0.01 to 2 m, advantageously 0.5×the width L of the fiber web+0.3 to 1 m. The turn-up device also comprises means to guide the reject part R detached from the fiber web W into a pulper of the reel-up (not shown). The means 14 to stop the cutting by the water jet nozzles 10, 12 between cutting of the tail end V1 and cutting of the beginning end V2 stop water inlet of the nozzles 10, 12 for a selected time. The means 14 to stop water inlet of the nozzle comprise at least one pressure break valve or at least one mechanical means or at least one means to change the direction of cutting of the nozzle.

Above the invention has been described by referring to an advantageous example only to which the invention is not to be narrowly limited. Many modifications and alterations are possible within the inventive idea.

We claim:

1. A turn-up method in a reel-up for reeling of fiber webs, comprising the steps of:

cutting in a reel-up, a fiber web travelling in a machine direction, wherein the fiber web defines a first machine direction edge and a second opposed machine direction edge; wherein the cutting is performed with a first water jet nozzle connected to a first source of cutting pressure and a second water jet nozzle connected to a second source of cutting pressure; wherein the first water jet nozzle forms a first cut, starting at the first machine direction edge, and the second water jet nozzle forms a second cut starting at the second opposed machine direction edge;

moving the first water jet nozzle and the second water jet nozzle toward each other in a cross-machine direction with respect to the fiber web toward a center area of the fiber web, which center area is about equally spaced between the first and second machine direction edges;

causing the first and second cuts to meet or cross at the center area of the fiber web to form a convex shaped tail end to the fiber web which comes to a point;

after forming the convex shaped tail end of the fiber web, pausing the movement of the first and second water jet nozzles and pausing cutting with the first and second water jet nozzles long enough to prevent formation of more than one reject part of the fiber web;

after pausing the first and second water jet nozzles and the cutting action of the first and second water jets, restarting the movement of the first and second water jet nozzles from the center area of the fiber web and the cutting action of the first and second water jet nozzles from the center area of the fiber web; and moving the water jet nozzles from the center area of the fiber web to one of the opposed machine direction edges of the fiber web so that the fiber web is cut by a third cut and a fourth cut to form a convex shaped beginning end of the fiber web which begins with a point and between the cuts for the tail end and the cuts for the beginning end forming only one reject part of the fiber web.

2. The turn-up method of claim 1 wherein the step of the first water jet nozzle forming the first cut begins outwardly of the fiber web or at the first machine direction edge; and wherein the step of the second water jet nozzle forming the second cut begins outwardly of the fiber web or at the second machine direction edge.

3. The turn-up method of claim 1 wherein after the step of pausing the movement of the first and second water jet nozzles and pausing cutting with the first and second water jets nozzles, the first water jet nozzle returns to the first machine direction edge, and the second water jet nozzle returns to the second opposed machine direction edge.

4. The turn-up method of claim 1 wherein during the step of pausing the movement of the first and second water jet nozzles and pausing cutting with the first and second water jet nozzles both the movement of the first and second jet nozzles are stopped, and the cutting of the first and second water jets nozzles are stopped, for 0.05-3 seconds.

5. The turn-up method of claim 4 wherein both the movement of the first and second jet nozzles are stopped, and the cutting of the first and second water jets nozzles are stopped, for 0.1-0.5 seconds.

6. The turn-up method of claim 1 further comprising the step of allowing the formed one reject part to detach or detaching the one reject part from the fiber web and drawing the reject part into a pulper of the reel-up.

7. The turn-up method of claim 1 further comprising the steps of:

applying an adhesive to the tail end; and attaching the tail end to a complete parent roll reeled by the reel-up.

8. The turn-up method of claim 1 further comprising the steps of:

applying an adhesive on the beginning end; and picking up and attaching the beginning end of the fiber web onto a new reeling shaft; and beginning reeling of a next parent roll by the reel-up on said new reeling shaft.

9. The method of claim 1 wherein the step of moving the water jet nozzles so that the fiber web is cut by a third cut and a fourth cut to form a convex shaped beginning end of the fiber web is carried out to cut a V-shaped beginning end of the fiber web, and wherein the step of causing the first and second cuts to meet or cross at the center area of the fiber web to form a convex shaped tail end to the fiber web is carried out to cut a V-shaped tail end to the fiber web.

10. A turn-up method in a reel-up for reeling of fiber webs, comprising the steps of:

cutting, in a reel-up, a fiber web travelling in a machine direction, wherein the fiber web defines a first machine direction edge and a second opposed machine direction edge;

wherein the cutting is performed with a first water jet and a second water jet;

wherein the first water jet makes a first cut, starting at the first machine direction edge, and the second water jet makes a second cut starting at the second opposed machine direction edge;

moving the first water jet and the second water jet toward each other in a cross-machine direction with respect to the fiber web toward a center area of the fiber web, which center area is about equally spaced between the first and second machine direction edges;

causing the first and second cuts to meet or cross at the center area of the fiber web to form a convex shaped tail end to the fiber web which comes to a point;

after forming the convex shaped tail end of the fiber web, turning off the first and second water jets long enough to prevent formation of more than one reject part of the fiber web;

turning on the first and second water jets and returning the first and second water jets from the center area of the fiber web to the first and second machine direction edges of the fiber web so that the fiber web is cut by a third cut and a fourth cut to form a convex shaped beginning end of the fiber web which begins with a point and between the cuts for the tail end and the cuts for the beginning end forming only one reject part of the fiber web.

11. The turn-up method of claim 10 wherein the step of turning off the first and second water jets long enough to prevent formation of more than one reject part of the fiber web further comprises stopping movement of the first jet and the second jet for 0.05-3 seconds.

12. The turn-up method of claim 11 wherein movement of the first and second jet are stopped for 0.1-0.5 seconds.

13. The turn-up method of claim 10 further comprising the step of allowing the one reject part to detach or detaching the one reject part from the fiber web and drawing the reject part into a pulper of the reel-up.

14. The turn-up method of claim 10 further comprising the steps of:

applying an adhesive to the tail end; and attaching the tail end to a complete parent roll reeled by the reel-up.

15. The turn-up method of claim 10 further comprising the steps of:

applying an adhesive on the beginning end; and picking up and attaching the beginning end of the fiber web onto a new reeling shaft; and beginning reeling of a next parent roll by the reel-up on said new reeling shaft.

16. The method of claim 10 wherein the step of causing the first and second cuts to meet or cross at the center area of the fiber web to form a convex shaped tail end is carried out to cut a V-shaped tail end to the fiber web, and wherein the step of turning on the first and second water jets and returning the first and second water jets from the center area of the fiber web to the first and second machine direction edges of the fiber web so that the fiber web is cut by a third cut and a fourth cut to form a convex shaped beginning end of the fiber web is carried out to cut a V-shaped beginning end of the fiber web.

* * * * *